United States Patent [19]

Miller

[11] 4,038,771

[45] Aug. 2, 1977

[54] LOAD SAFETY DEVICE FOR REVOLVERS

[76] Inventor: Leland D. Miller, R.R. No. 1, Tonganoxie, Kans. 66086

[21] Appl. No.: 728,043

[22] Filed: Sept. 30, 1976

[51] Int. Cl.[2] ..... F41C 17/00

[52] U.S. Cl. ..... 42/1 LP; 42/66

[58] Field of Search ..... 42/1 LP, 59, 62, 66, 42/89

[56] References Cited

U.S. PATENT DOCUMENTS

| | | | |
|---|---|---|---|
| 2,327,334 | 8/1943 | Parker | 42/1 LP |
| 2,887,807 | 5/1959 | Santangelo | 42/1 LP |
| 3,360,880 | 1/1968 | Finnegan | 42/1 LP |

*Primary Examiner*—Charles T. Jordan

*Attorney, Agent, or Firm*—John A. Hamilton

[57] ABSTRACT

A load safety device for a revolver having a cylinder movable laterally from the gun receiver to a position in which its rearward face is unobstructed for insertion of cartridges into the chambers thereof, and having an ejector operable to move the cartridges rearwardly from the chambers, the safety device consisting of a hollow receptacle positionable over the rearward end of the cylinder to receive the cartridges as they are partially ejected from the cylinder, the receptacle having a spring-loaded pressure plate biasing the cartridges toward full engagement in the cylinder, and a connector for releasably joining the receptacle to the ejector operating rod to secure the cartridges in a partially ejected position.

8 Claims, 10 Drawing Figures

LOAD SAFETY DEVICE FOR REVOLVERS

This invention relates to new and useful improvements in safety devices for firearms, and has particular reference to a safety device for use in connection with revolvers.

In a revolver, the cartridges are carried in chambers formed in a cylinder rotatable in an opening formed therefor in the receiver portion of the gun. The chambers are disposed eccentrically of the cylinder, so that when the cylinder is turned about its axis by a cocking action initiated by pulling the trigger, the chambers are brought successively into operative relationship with the firing pin and gun barrel. The cylinder is so mounted in the receiver as to be movable laterally from the receiver opening, thereby exposing the rearward ends of the chambers for loading cartridges therein. The gun is also provided with a manually operable ejector which functions, when the cylinder is in its extended loading position, to eject the expended cartridge cases, and of course any remaining live cartridges, from the cylinder chambers. Thus far, all of the structure described is common to virtually all revolvers.

The object of the present invention is the provision of a safety device for a revolver which, when operatively applied to the gun, effectively locks the cylinder in its extended position out of the opening provided therefor in the receiver, and partially ejects the cartridges from the cylinder chambers. It is clear that these conditions supply an extremely high degree of safety in gun handling, in that the gun cannot be fired accidentally despite virtually any type of rough or careless handling.

Another object is the provision of a safety device of the character described which, despite the extension of the cylinder and the partial cartridge ejection provided thereby, nevertheless permits extremely rapid readying of the gun for firing when required.

Generally, these objects are accomplished by the provision of a safety device including a cup-shaped receptacle adapted to be applied, open end first, to the rearward end of the revolver cylinder when said cylinder is in its extended position, whereby the cartridges, when partially ejected, enter said receptacle. A bail member carried by the receptacle engages the operating rod of the ejector, both to secure the ejector in a position to maintain partial ejection of the cartridges into the receptacle, and also to secure the receptacle in engagement with the cylinder. A spring-loaded pressure plate carried in the receptacle biases the cartridges toward full insertion in the cylinder, so that full insertion occurs whenever the bail is disengaged from the ejector rod.

Other objects are simplicity and economy of structure, and convenience and dependability of operation.

With these objects in view, as well as other objects which will appear in the course of the specification, reference will be had to the accompanying drawing, wherein.

Figure 3:
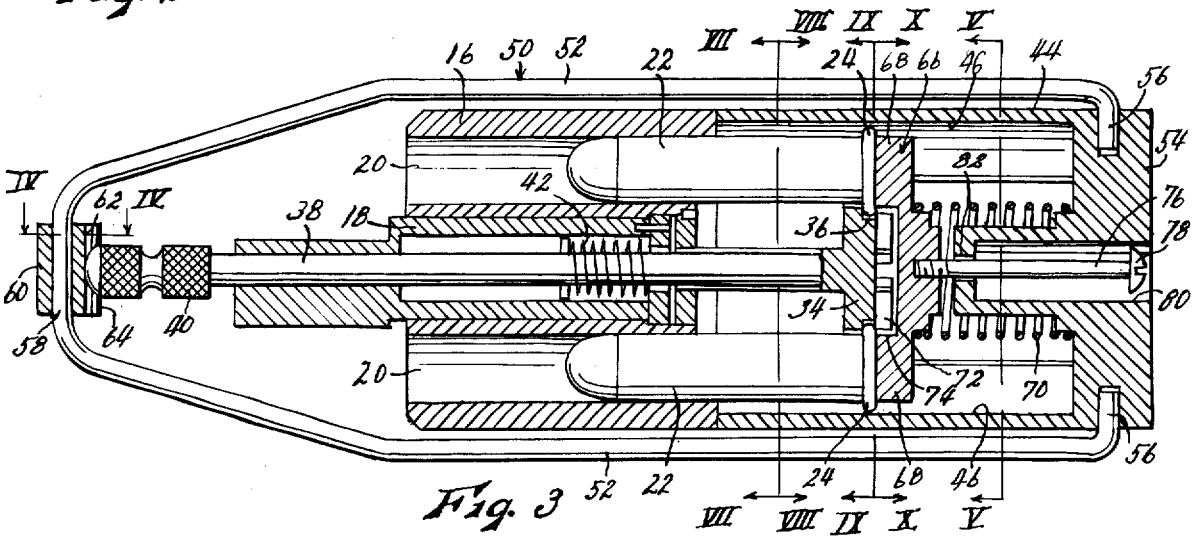
FIG. 3 is an enlarged sectional view taken on line III—III of FIG. 2.
Figure 6:
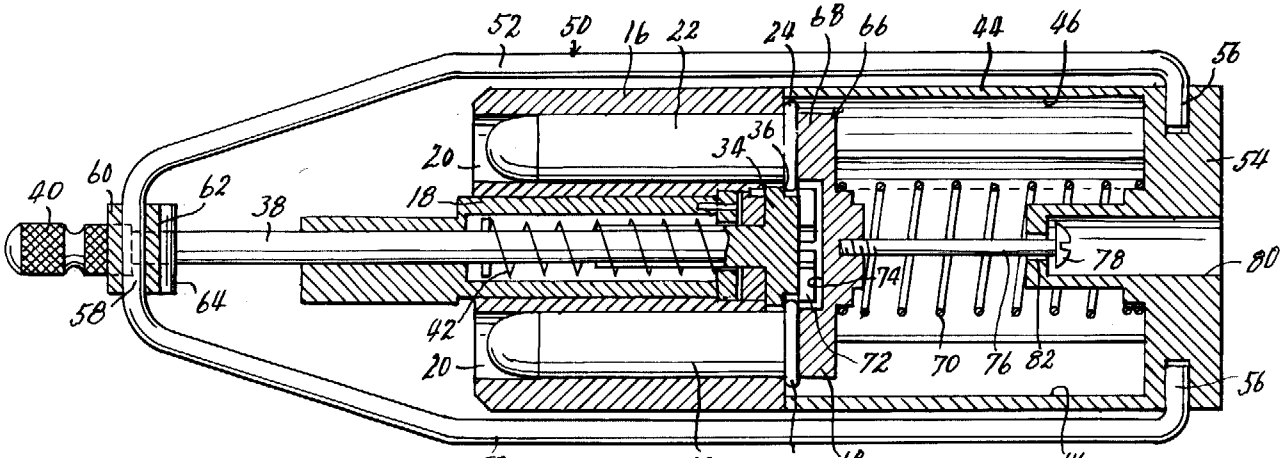
Figure 10:
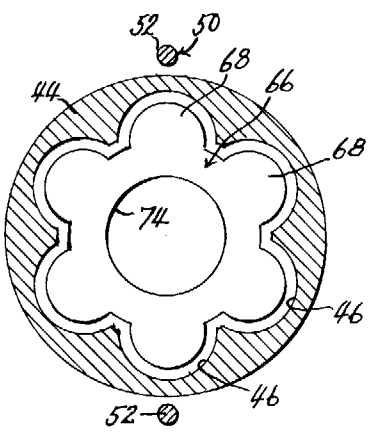
Figure 9:
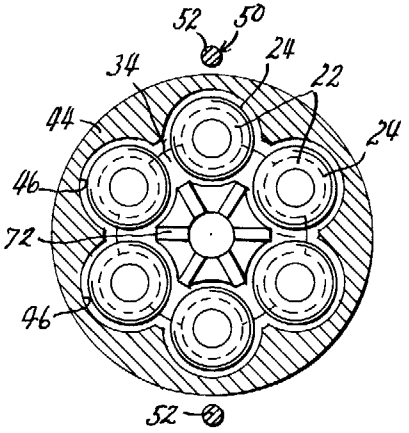
Figure 8:
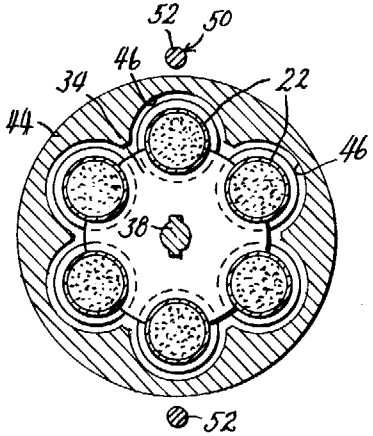
Figure 7:
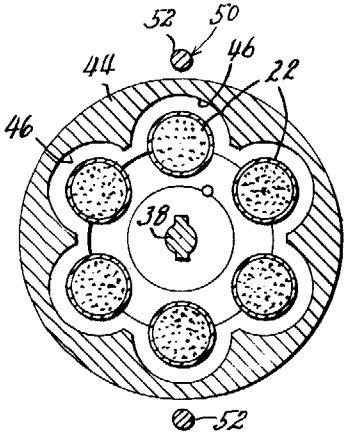

FIG. 6 is a view similar to FIG. 3, but showing the position of the parts immediately prior to the ejection of the cartridges into the safety receptacle, FIG. 7 is a sectional view taken on line VII—VII of FIG. 3, FIG. 8 is a sectional view taken on line VIII—VIII of FIG. 3, FIG. 9 is a sectional view taken generally on line IX—IX of FIG. 3, showing a face view of the cartridge bases and ejector, and FIG. 10 is a sectional view taken generally on line X—X of FIG. 3, showing a face view of the pressure plate of the safety receptacle.

Like reference numerals apply to similar parts throughout the several views, and the numeral 2 applies generally to a revolver of ordinary design, including a receiver or frame member 4, a barrel 6, hand grip 8, hammer 10, and trigger 12, all associated in the usual well known manner. Receiver 4 is generally flat in a plane including the barrel axis, and has a rectangular opening 14 formed transversely therethrough, the cylinder 16 of the gun normally being positioned within said opening, with its axis parallel with but spaced below the barrel axis. Said cylinder is rotatable on an axial tubular spindle 18 and has a series, usually six, of chambers 20 formed throughout the length thereof eccentrically to its axis at regularly spaced angular intervals, each chamber being adapted to receive a cartridge 22 slidably therein, each cartridge having a rim 24 of enlarged diameter normally seating against the rearward face of the cylinder. When the cylinder is disposed within opening 14, it is locked in that position by a suitable locking device, not shown but normally releasable by means of an external slide knob 26. It will be understood that when trigger 12 is pulled, it first operates a ratchet device, not shown but well understood in the art, to turn cylinder 16 by an angular distance equal to the angular spacing between successive chambers 20, whereby to align a chamber 20 with barrel 6, locks the cylinder in the new position, and cocks hammer 10. As the trigger pull is completed, the hammer is released and the gun fires, all as well understood in the art.

Figure 2:
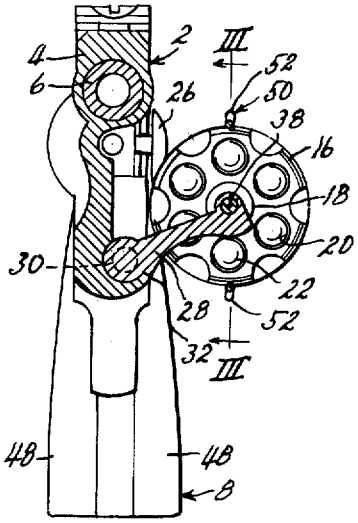
FIG. 2 is a sectional view taken on line II—II of FIG. 1.
Figure 4:
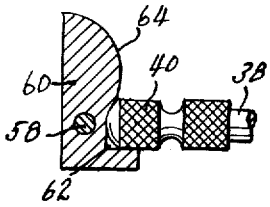
FIG. 4 is a fragmentary sectional view taken on line IV—IV of FIG. 3.
Figure 5:
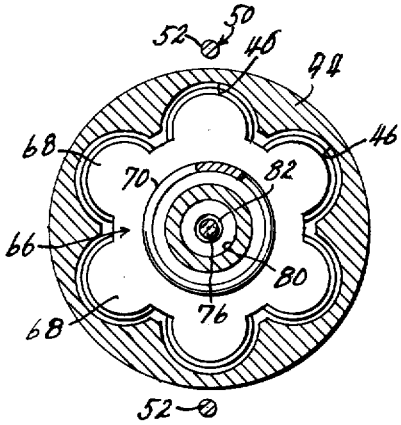
FIG. 5 is a sectional view taken on line V—V of FIG. 3.

Spindle 18 extends forwardly of cylinder 16, and is affixed at its forward end to a radially extending arm 28, said arm being pivoted at its opposite end to receiver member 4 on an axis parallel to the cylinder axis, as indicated at 30 in FIG. 2. Thus when slide knob 26 is manually operated to release the lock holding the cylinder in receiver opening 14, said cylinder may be pivoted outwardly and downwardly as best shown in FIG. 2, its outward movement being limited by cooperating abutment surfaces of the arm and receiver as indicated at 32. In this position, the rearward face of the cylinder is completely exposed so that cartridges 22 may be inserted into its chambers 20.

To eject spent cartridge cases, or live ammunition, from the cylinder chambers, an ejector plate 34 is provided. Said ejector plate is normally recessed in the rearward face of the cylinder, and is generally circular with rounded notches in its periphery which closely engage the body portions of each of cartridges 22, each notch having a shoulder 36, normally flush with the rearward face of the cylinder, which engages under the rim 24 of the associated cartridge. An ejector rod 38 is affixed to the ejector plate, and extends forwardly and slidably through cylinder spindle 18, and forwardly of said spindle, being provided at its exposed forward end with a rounded, knurled knob 40. Said ejector rod, and hence ejector plate 34, is biased forwardly at all times by a spring 42 carried in tubular spindle 18, but said rod may be manually pressed rearwardly against said spring, whereby to eject the cartridges or cartridge cases. Usually the cartridges are ejected only a portion of their lengths by the ejector mechanism, or to a point where they may either fall free of the cylinder, or may easily be grasped and pulled free.

All of the generally described revolver structure thus far set forth is common and well known in the gun art, and further detailing thereof is not believed pertinent to the present invention.

Figure 1:
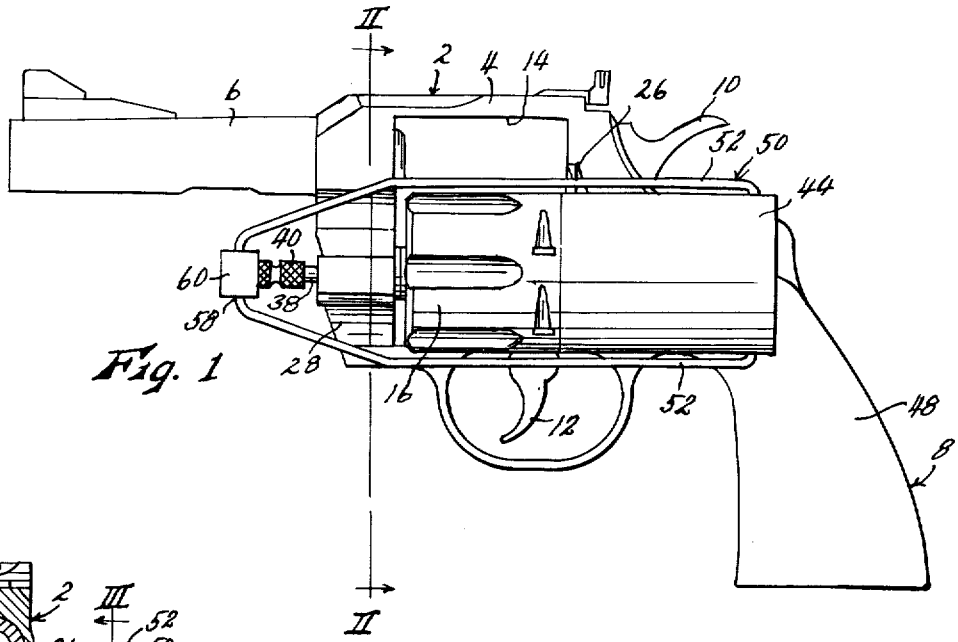
FIG. 1 is a side elevational view of a revolver, showing a safety device embodying the present invention applied operatively thereto.

The safety device contemplated by the present invention includes a cylindrical, cup-shaped receptacle 44, substantially equal in diameter to cylinder 16, and which may be formed of any suitable material such as metal, plastic or wood. Said receptacle, in use, is applied, open end first, to the rearward face of cylinder 16, in coaxial relation to said cylinder, when said cylinder is in its extended position pivoted outwardly from receiver opening 14, as shown in FIGS. 1 and 2. Internally, said receptacle is longitudinally fluted with cylindrically curved scallops 46, as shown in FIGS. 5 and 7 - 10, said scallops corresponding in number and angular spacing to chambers 20 of the cylinder, and of slightly greater diameter of cylindrical curvature than the rims 24 of the cartridges. Thus, when the receptacle is applied to the cylinder as described, the receptacle scallops engage about the cartridge rims, whereby both to secure the receptacle against radial displacement relative to the cylinder, and also to secure the receptacle and the cylinder in a fixed angular relationship. Thus, when ejector rod 38 is pressed rearwardly by manual pressure on its knob 40, cartridges 22 are moved rearwardly so that a portion of their lengths are contained in receptacle 44.

The rearwardly extended cylindrical form of cylinder 16, when in its extended position, may not be entirely open, since certain elements of the gun structure may impinge slightly thereinto, such as the slide knob 26 of the cylinder lock, and the hand grip plate 48 at that side of the frame, as will be apparent in FIG. 2. However, receptacle 44 may still by placed as described by slightly relieving or cutting away the external surface of the receptacle at the appropriate points. This relieving of the receptacle is not illustrated but is readily apparent, and does not interfere with the functions of the receptacle so long as it is of sufficiently slight degree. Of course, it may result in the fact that the receptacle can be applied to the cylinder in only one angular position, and this in turn may require that the cylinder be turned slightly on spindle 18 to align the cartridges properly with scallops 46 of the receptacle.

The receptacle is secured in the position described by a generally U-shaped wire bail 50, the side arms 52 of which are spaced apart by a distance greater than the diameter of cylinder 16 and receptacle 44. At their rearward ends, said side arms are turned inwardly and pivoted coaxially in the thickened base portion 54 of receptacle 44, as indicated at 56, on an axis diametric to the receptacle axis. At their forward ends, arms 52 are joined by a transverse portion 58 of the bail, to which is affixed a block 60 having a recess 62 on its rearward surface for receiving the rounded forward end of knob 40 of ejector rod 38. The length of the bail is such that knob 40 can be engaged in block recess 62 only when the ejector rod has been pressed rearwardly by manual force to move cartridges 22 partially into receptacle 44. Block 60 is provided with a rounded cam surface 64 which facilitates its engagement with knob 40.

When the receptacle is first applied to the cylinder, the parts have the relative positions shown in FIG. 6. Knob 40 of ejector rod 38 is then pressed rearwardly by manual force to move cartridges 22 partially into the receptacle, and bail 50 is pivoted to engage recess 62 of block 60 with said knob, whereby to secure the ejector rod in its rearward position, the parts then having the positions shown in FIG. 3. When block 60 is disengaged from knob 40, the ejector rod is returned to its forward position by spring 42. The receptacle may be conveniently held in position against cylinder 16 while engaging or disengaging block 60 with or from knob 40 by thumb pressure against its base 54, using the thumb of the hand grasping grip 8, while using the other hand to manipulate the ejector rod and bail 50.

To provide that cartridges 22 will be fully re-inserted into cylinder 16 whenever block 60 is disengaged from knob 40 of the ejector rod, there is provided a pressure plate 66 mounted in receptacle 44. Said pressure plate is disposed normally to the axis of the receptacle, and corresponds generally in shape to the internal cross-sectional contour of the receptacle, having a series of peripheral lobes 68 each extending into one of the internal scallops 46 of the receptacle to overlie the base of one of cartridges 22. Said pressure plate is biased resiliently toward the open end of the receptacle by a compression spring 70 disposed between said plate and the base 54 of the receptacle. When the receptacle is applied to the revolver cylinder, as in FIG. 6, the rearward face of the pressure plate abuts the bases of cartridges 22, compressing spring 70 very slightly. In this connection, it should be noted that the rearward surface of ejector plate 34 normally carries a series of radially extending ratchet ribs 72 forming a part of the previously mentioned cylinder turning mechanism operable by pulling trigger 12. These ribs project rearwardly of the cartridge bases, and the face of pressure plate 66 has a recess 74 formed therein for receiving said ribs, in order that said pressure plate may press firmly against the bases of the cartridges. Thus whenever ejector rod 38 is pressed rearwardly to move the cartridges partially into the receptacle, they force pressure plate 66 rearwardly to compress spring 70, and when bail block 60 is disengaged from knob 40 of the ejector rod, the ejector rod is moved forwardly by spring 42, while cartridges 22 are pressed forwardly for full re-insertion in the cylinder chambers by pressure plate 66, which is urged forwardly by spring 70. The pressure plate is further guided, and its motion limited so that it cannot be extended out from the open end of the receptacle, by an elongated screw 76 threaded axially into the rearward surface of said pressure plate, and having its head 78 disposed in a deep axial socket 80 formed in the base 54 of receptacle 44, the shank of said screw passing slidably through a hole 82 formed in the base of said socket, said hole being too small to pass head 78. The length of said screw is such as to permit spring 70 to move pressure plate 66 only to a position just inside the open mouth of the receptacle, preferably being spaced inwardly of said mouth by a distance less than cartridge rims 24.

The operation of the subject safety device is believed to have been fully and completely described in connection with the foregoing description of its construction.

It is obviously highly effective for its intended purposes. When it is fully applied, as illustrated in FIGS. 1 - 4, the revolver cylinder 16 is locked in its extended position outside of the receiver portion of the gun, and the cartridges are secured in a position of partial ejection from the cylinder, but are nevertheless fully enclosed and protected within receptacle 44. Under these conditions, it is virtually inconceivable that accidental firing could occur as a result of any type of rough or careless handling. The device may be both applied to and removed from the gun easily, rapidly and conveniently, and when removed, the full reinsertion of the cartridges into the cylinder by pressure plate 66 contributes significantly to readying the gun for immediate use, if this should be necessary. Of course, a gun equipped with the present safety device cannot be carried in a holster, unless the holster is specially formed, but the present device is not intended for this usage, but for the protection of guns in storage or during other longer periods of non-use.

While I have shown and described a specific form of my invention, it will be readily apparent that many minor changes of structure and operation could be made without departing from the spirit of the invention. For example, so far as actual safety is concerned, pressure plate 66 and spring 70 could be dispensed with, and receptacle 44 be made only sufficiently deep to receive the partially ejected cartridges. However, when the safety device was then removed, the cartridges would be left in their partially ejected positions, requiring that their reinsertion into the cylinder chambers be completed manually, and increasing the time required to ready the gun for firing. The use of the pressure plate and spring is therefore preferred.

What I claim as new and desire to protect by Letters Patent is:

1. In combination with a revolver having a receiver and a cylinder having cartridge chambers formed therein parallel to its axis, said cylinder normally being disposed within said receiver in a firing position but being movable transversely of said barrel axis to an extended position outside of said receiver to expose the rearward end thereof for the insertion or removal of cartridges into or from the chambers thereof, and an ejector mechanism operable by a manually movable operating member to move cartridges in said chambers to the rear so as to be only partially engaged in said chambers, a safety device comprising:

a. a generally cylindrical, cup-shaped receptacle open at one end and adapted to be applied open end first to the rearward end of said cylinder coaxially with said cylinder, when said cylinder is in said extended position whereby to receive therein the rearward end portions of said cartridges as said cartridges are partially ejected from said cylinder chambers by said ejector mechanism, and b. securing means carried by said receptacle and releasably engageable with said operating member of said ejector mechanism, and being operable when so engaged both to secure said receptacle in engagement with said cylinder, and to secure said ejector mechanism in a position to maintain said cartridges in a position partially ejected from said cylinder into said receptacle.

2. The combination as recited in claim 1 wherein said receptacle is generally cylindrical and its open forward end is adapted to abut the rearward face of said cylinder in encircling relation to the cartridges carried by said cylinder, the rim portions of said cartridges being too large to enter said chambers so as to project rearwardly of the rearward face of said cylinder and to enter said receptacle, whereby to prevent radial displacement of said receptacle relative to said cylinder.

3. The combination as recited in claim 2 wherein said securing means is operable to press said receptacle axially against the rearward face of said cylinder.

4. The combination as recited in claim 1 wherein said ejector mechanism includes an ejector plate normally disposed at the rearward face of said cylinder, and having rearwardly facing abutments engaging the rims of all cartridges carried by said cylinder, an ejector rod fixed to said ejector plate and extending forwardly and slidably through said cylinder, extending forwardly of said cylinder to be exposed, whereby rearward pressure on the forward end of said rod causes said rod and ejector plate to eject said cartridges partially from said cylinder, and spring means biasing said ejector rod and plate forwardly, and wherein said securing means constitutes:

a. a U-shaped bail the side arms of which lie in planes generally parallel to the receptacle axis, the free ends of said side arms being pivotally connected to said receptacle on an axis transverse to the receptacle axis, said side arms being spaced transversely apart sufficiently to bridge the diameters of said receptacle and said cylinder, and b. a block affixed to the connecting portion of said bail and having a recess formed in the rearward face thereof engageable with the forward end of said ejector rod, said side arms being of such length that said block may engage said ejector rod only when said rod is moved rearwardly to eject said cartridges partially from said cylinder, whereby said spring means acts through said ejector rod and said bail to press said receptacle axially against said cylinder.

5. The combination as recited in claim 4 wherein the open end of said receptacle engages the rearward face of said cylinder in encircling relation to the cartridges carried by said cylinder, the rim portions of said cartridges projecting rearwardly from the rearward face of said cylinder to be disposed within said receptacle, whereby to secure said receptacle against radial displacement relative to said cylinder.

6. The combination as recited in claim 1 with the addition of:

a. a pressure plate normal to the axis of said receptacle disposed within said receptacle for movement parallel to the axis thereof, and engaging the bases of said cartridges, whereby to be forced rearwardly into said receptacle by said cartridges whenever said cartridges are partially ejected from said cylinder by said ejector mechanism, and b. resilient means biasing said pressure plate toward the open end of said receptacle, whereby whenever said ejector mechanism is positioned inactively, said pressure plate will move said cartridges forwardly to re-insert them fully into said cylinder.

7. The combination as recited in claim 6 wherein the face of said pressure plate engageable with the bases of said cartridges is recessed to accomodate any portion of the gun mechanism carried by the cylinder which may project rearwardly beyond the bases of said cartridges when said cartridges are fully inserted n the cylinder, whereby said pressure plate may function to reinsert said cartridges fully.

8. The combination as recited in claim 6 with the addition of stop means operable to limit the movement of said pressure plate by said resilient means to a position in which the operative face of said pressure plate is disposed inwardly from the open end of said receptacle by a distance less than the thickness of the rim portions of said cartridges in a direction axial to said cartridges.

* * * * *